US006840848B1

(12) United States Patent
Dyar

(10) Patent No.: US 6,840,848 B1
(45) Date of Patent: Jan. 11, 2005

(54) BUSHINGS AND ABRASIVE WHEEL THEREWITH

(76) Inventor: Ralph E. Dyar, 1023 Lakeview Dr., Beverly, OH (US) 45715

( * ) Notice: Subject to any disclaimer, the term of this patent is extended or adjusted under 35 U.S.C. 154(b) by 62 days.

(21) Appl. No.: 10/310,187

(22) Filed: Dec. 4, 2002

(51) Int. Cl.[7] ..... B24B 23/00; B24B 9/02
(52) U.S. Cl. ..... 451/344; 451/466; 451/508
(58) Field of Search ..... 451/342, 366–369, 451/490, 463, 508–512, 523–526, 344, 466, 468, 469, 521

(56) References Cited

U.S. PATENT DOCUMENTS

| | | | | |
|---|---|---|---|---|
| 2,678,523 A | | 5/1954 | Leggett | |
| 2,798,343 A | * | 7/1957 | Aleck | 451/469 |
| 2,818,692 A | * | 1/1958 | Bernstein | 451/469 |
| 2,842,902 A | * | 7/1958 | Miller et al. | 451/469 |
| 3,004,373 A | | 10/1961 | Brooks | |
| 3,188,777 A | * | 6/1965 | Aleck | 451/469 |
| 3,200,543 A | * | 8/1965 | O'Neil, Jr. et al. | 451/469 |
| 3,406,488 A | | 10/1968 | Rykken | |
| 3,406,496 A | | 10/1968 | Betteridge et al. | |
| 3,561,173 A | | 2/1971 | Block | |
| 3,600,861 A | | 8/1971 | Haywood | |
| 4,258,509 A | | 3/1981 | Wray et al. | |
| 4,275,529 A | | 6/1981 | Teetzel et al. | |
| 4,455,788 A | | 6/1984 | Freerks | |
| 5,177,830 A | | 1/1993 | Montabaur et al. | |

* cited by examiner

*Primary Examiner*—Hadi Shakeri
(74) *Attorney, Agent, or Firm*—R. William Graham

(57) ABSTRACT

A bushing is disclosed for use with a grinding abrasive flap wheel of the type employing circular end caps mounted on opposite sides of an annular array of abrasive leaves, wherein bases of the leaves are interconnected by an adhesive and have two notches in their opposite side edges near each base end of each leaf such that the notches form concentric circular depressions on opposite sides of the array and each end cap has an outer rim portion and an arcuate lip inwardly extending therefrom which engages the circular depressions formed by the notches thereby mechanically gripping the ends of the abrasive leaves.

12 Claims, 3 Drawing Sheets

BUSHINGS AND ABRASIVE WHEEL THEREWITH

BACKGROUND OF THE INVENTION

1. Field of the Invention

This invention relates to a bushing for use with a grinding abrasive flap wheel having interleaved coated abrasive flaps.

2. Prior Art

Flap-type rotary abrasive devices having annular arrays of flexible abrasive leaves are commonly used in the abrasive finishing art. For economic reasons, conventional rotary abrasive devices consist of flexible leaves each comprising a piece of sheet material having abrasive particles bonded on one face thereof.

Fabrication of such a rotary device conventionally requires that the abrasive leaves have two notches in their opposite side edges near the base end of each leaf. As the leaves are arranged in an annular array, the notches form concentric circular depressions on opposite sides of the array.

Circular disks such as two metallic end caps mounted on opposite sides of the array are provided serve as reinforcement for the arrangement of leaves. Each end cap has an inwardly extending lip which engages the circular depressions thereby mechanically gripping the inner ends of the abrasive leaves. An adhesive is commonly introduced into contact with the leaves at their base ends to bond them into a unitary core.

The design of abrasive configurations has varied somewhat, but the basic elements remain similar for manufacturing and cost reasons. A significant problem which exists with such abrasive flap devices is that the flaps tend to blow out prematurely during use. This is typically due to a slight bowing in the flaps which results from pressure exerted on a bearing surface surrounding a central opening of hubs of the end caps which over time disfigures the end cap. This effect is illustrated in FIG. 2. Traditional designs run a drive shaft through the hubs of the end caps with the caps being locked in place on the shaft by nut. Thus, the hubs bear significant force during use.

The present invention discloses bushings for use with a grinding abrasive flap wheel. By so providing, the present invention overcomes the deficiencies in the art and further reduces the cost of manufacture of abrasive flap wheels while increasing the life thereof

SUMMARY OF THE INVENTION

It is an object to reduce the cost of manufacturing grinding abrasive flap wheel.

It is a further object to increase the life of a grinding abrasive flap wheel without the need to significantly depart of conventional design.

It is still another object to provide a bushing for use with a grinding abrasive flap wheel.

It is another object to provide an improved abrasive wheel.

Accordingly, the present invention is directed to a bushing for use with a grinding abrasive flap wheel of the type employing circular end caps mounted on opposite sides of an annular array of abrasive leaves, wherein bases of the leaves are interconnected by an adhesive and have two notches in their opposite side edges near each base end of each leaf such that the notches form concentric circular depressions on opposite sides of the array and each end cap has an outer rim portion and an arcuate lip inwardly extending therefrom which engages the circular depressions formed by the notches thereby mechanically gripping the ends of the abrasive leaves.

The bushing includes a rigid disk member having an outer diameter formed with an laterally extending lip which is configured to at least partially seat within a concave portion of the arcuate lip and engage the rim portion of the end cap. The bushing includes a central hub having a central opening which cooperatively aligns with a central opening of the end cap to receive a drive shaft therethrough. The hub of the bushing can include an axially extending collar portion which has an outer diameter slightly less than the central opening of the end cap to be slidably received therethrough.

An annular inner surface of the bushing extends from the collar to the inwardly extending lip and is disposed adjacent an outer surface of the end cap. Preferably, an inwardly disposed portion of the annular inner surface is recessed such that an outer portion generally serves as a contacting surface portion with the outer surface of the end cap. Another aspect of the invention is to provide a high torque abrasive wheel and bushings.

Additionally, the bushing can include one or more bores which extend inwardly from an outer surface thereof. The bores are preferably radially equidistantly spaced for balance and aid in placement of the bushing to and from the end cap.

An important advantage of the invention is that laterally extending lip and contacting surface portion of the inner surface of the bushing becomes a retaining surface on the end cap with the retention force being applied to the rim of the end cap. In other words, the significant driving force being applied to the end cap during use has been shifted from the inner weaker bearing surface to the stronger outer rim portion of the end cap. The invention also provides for enhanced torque capability. This substantially precludes the bowing tendency which would normally occur through a nut and bolt clamping effect at the central portion of the end cap.

Other objects and advantages will become apparent from reading the specification in view of the drawings attached hereto.

DETAILED DESCRIPTION OF THE PREFERRED EMBODIMENT

Figure 2:
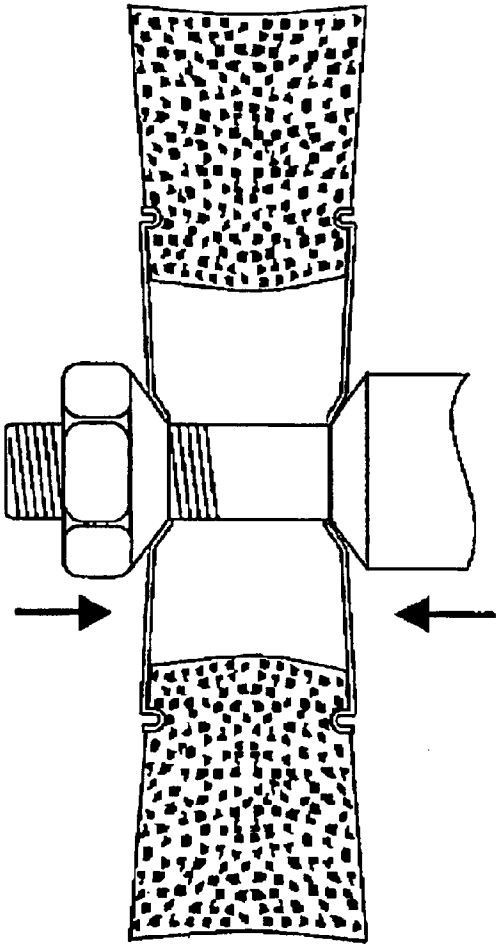
Fig. 2 Prior Art
FIG. 2 is a cross sectional view of a prior abrasive flap wheel showing the deformation which occurs from use and damage to the wheel as a result thereof.
Figure 1:
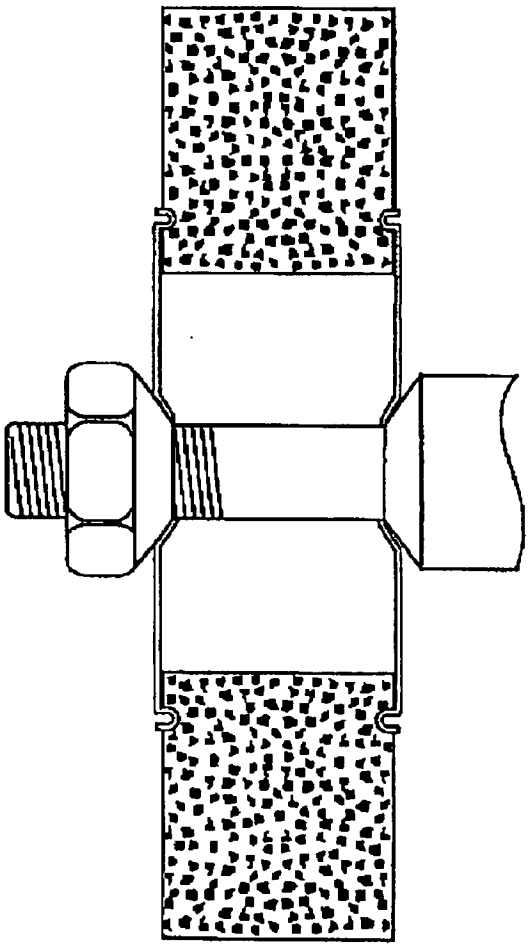
Fig. 1 Prior Art
FIG. 1 is a cross sectional view of a prior abrasive flap wheel.
Figure 3:
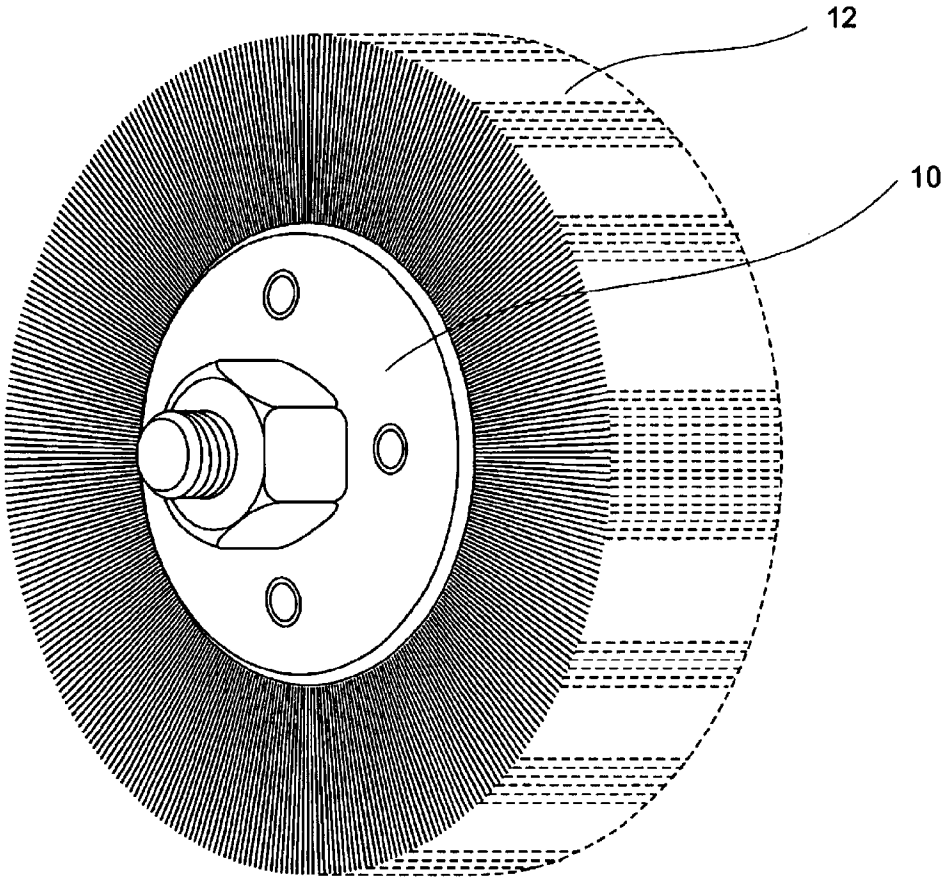
FIG. 3 is a perspective view of a rotary abrasive device according to the present invention.

Referring now to the drawings, the bushing(s) of the present invention are generally referred to by the numeral 10 and are depicted for use with an abrasive flap wheel 12. There are two bushings 10 depicted, but the description refers to the singular. The bushing 10 includes a rigid disk 14 which can be made of metal such as stainless steel or other suitable durable material and is preferably of a significant mass to further aid in carrying out the purpose of the present invention. In order to more fully describe the bushing 10, the flap wheel will first be described.

The abrasive flap wheel 12 includes a pair of circular end caps 13 and 15 mounted on opposite sides of an annular array of abrasive leaves 16. Each leaf 16 includes base 18 and the bases 18 of the leaves 16 are interconnected by an adhesive material 20 of the type well known to the art. Each leaf has two notches 22 and 24 in its opposite side edges 26 and 28, respectively, near each end of base 18 of each leaf 16.

Figure 4:
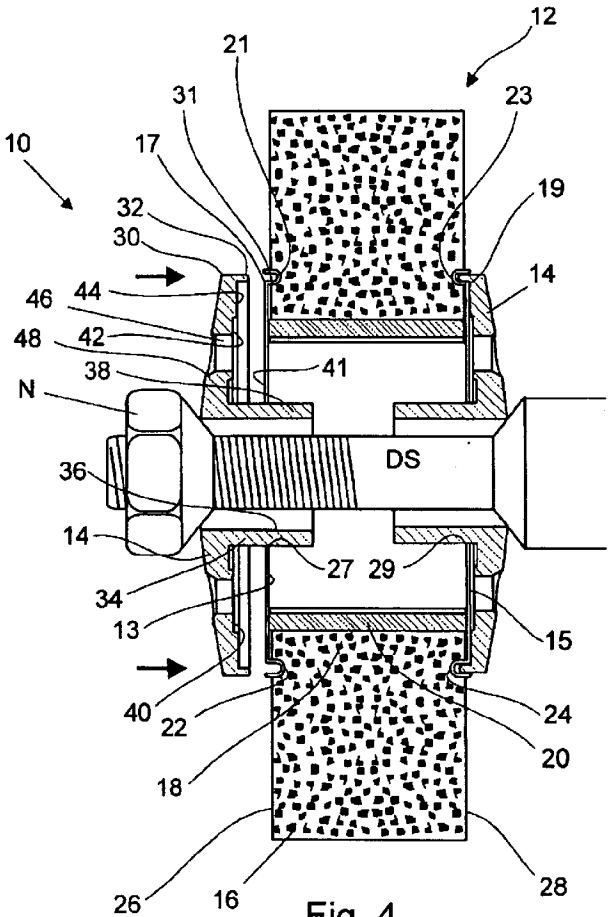
FIG. 4 is a cross sectional view taken along lines 4—4 of FIG. 5 showing one bushing displaced from the abrasive wheel and one in contact therewith.
Figure 5:
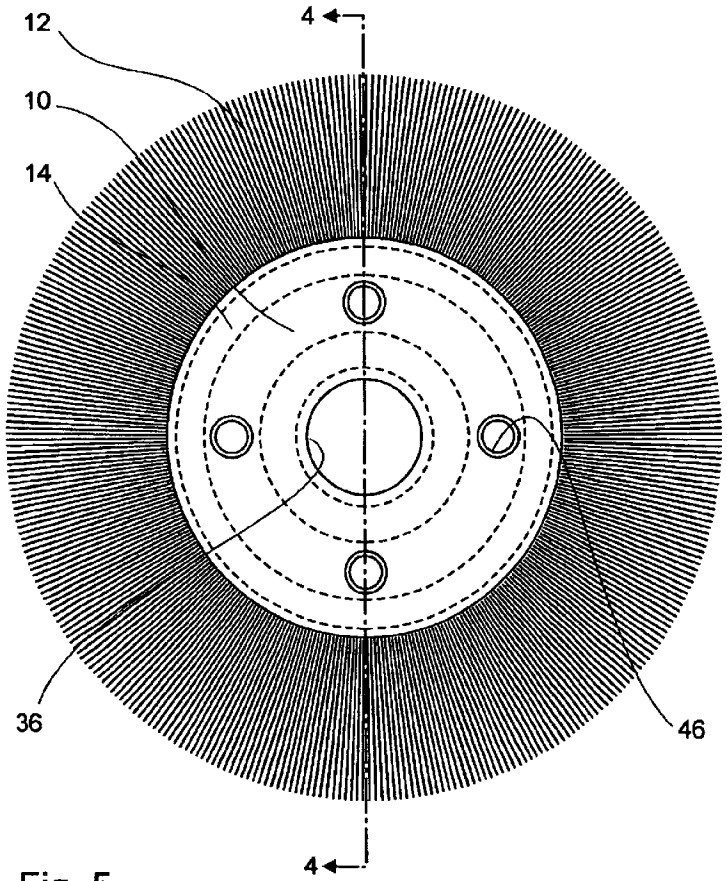
FIG. 5 is a side view of the invention.

When the leaves 16 are disposed in an annular array as seen in FIG. 5, for example, the notches 22 and 24 form concentric circular depressions on opposite sides of the array. Each end cap 13 and 15 has an outer rim portion 17 and 19, respectively, and an arcuate lip 21 and 23, respectively, extending inwardly therefrom which engages the circular depressions formed by notches 22 and 24, as seen in FIG. 4, thereby mechanically gripping the ends of the abrasive leaves 16 when in disposed in their operative position, for example. Further, the end caps 13 and 15 include a central open surface 27 and 29, respectively, which is modified from that of conventional end caps in that the open surfaces 27 and 29 are larger reasons which will be more fully understood hereinafter.

For purposes of simplifying the description, the bushing 10 will be described with reference to connection to one end cap 13, with the understanding that like connection is obtained to end cap 15. The bushing 10 has an outer diameter portion 30 formed with an laterally extending lip 32 which is configured to at least partially seat within a concave portion 31 of the arcuate lip 21 and engage the rim portion 17 of the end cap 13. The bushing 10 includes a central hub 34 having a central open surface 36 which cooperatively coaxially aligns with the central open surface 27 of the end cap 13.

The hub 34 of the bushing 10 includes an axially extending collar 38 which has an outer diameter slightly less than the central open surface 27 of the end cap 13 to be slidably received therethrough. The open surface 27 does not serve as a primary bearing surface.

An annular inner surface 40 of the bushing 10 extends from the collar 38 to the laterally extending lip 32 and is disposed adjacent an outer surface 41 of the end cap 13. Preferably, an inwardly disposed portion 42 of the annular inner surface 40 is recessed such that an outer portion 44 generally serves as a contacting surface portion with the outer surface 41 of the end cap 13.

Thus, the surfaces 41 and lip portion 32 are bearing surfaces of the bushing 10 such that when the end caps 13 and 15 are connected and drawn together by means of drive shaft DS and nut N. The rim portion 17 and 19 aid to prevent galling between the surface 27 and collar 38 which could otherwise occur without the redirection of the retaining and driving mechanism employed with the aid of the invention. The open surface 36 receives drive shaft DS therethrough which has a threaded end and nut N can be threaded to the drive shaft DS to draw the bushing 10 into to frictional engagement with the end cap 17. The drive shaft DS can be gripped by a chuck of a pneumatic motor or by any other commonly used power driving device.

In operation, the drive shaft DS is rotated in the direction in which the abrasive sides of the leaves 16 face. It is important that the annular array of leaves 16 rotate at a high angular velocity in order that rapid abrasion can be effected. This high angular velocity creates a significant centrifugal force outwardly, thereby requiring that the leaves 16 be securely fastened so that the array will not come apart during operation. According to the present invention, this is more readily achieved by the use of the bushing 10 which aids to maintain proper leaf position during operation.

Additionally, the bushing 10 can include one or more bores 46 which extend inwardly from an outer surface 48 through the inner surface 40. The bores 46 are preferably radially equidistantly spaced for balance and serve to aid in placement on as well as removal of the bushing 10 to the end cap 17.

Applicant has discovered that by providing the bushing and abrasive wheel combination of the present invention, there is an unexpected increase in performance of the wheel, recognizable by a significant increase in grain efficiency. It is to be recognized that other bushing and end cap configurations carrying out the purpose of the invention could be utilized. Accordingly, the specific embodiment disclosed is representative in providing a basis for the claims which define the scope of the present invention.

What is claimed is:

1. A bushing in combination with an abrasive flap wheel, comprising:

an abrasive flap wheel having circular end caps mounted on opposite sides of an annular array of abrasive leaves, wherein bases of said leaves are interconnected by an adhesive and have a notch in opposite side edges thereof near each base end of each leaf such that said notches form concentric circular depressions on opposite sides of said array and each end cap has a central open surface, an outer rim portion an arcuate lip inwardly extending therefrom which engages said circular depressions formed by said notches thereby mechanically gripping said ends of said abrasive leaves;

a rigid disk member having an outer diameter formed with a laterally extending lip which is configured to at least partially seat within a concave portion of said arcuate lip and engage and retain said end cap adjacent said rim portion thereof and a central hub on said disk member having a central open surface which cooperatively aligns with said central open surface of said end cap to receive a drive shaft therethrough.

2. The bushing in combination with the abrasive flap wheel of claim 1, wherein said hub of said bushing includes an axially extending collar portion having an outer diameter slightly less than a diameter of said open surface of the end cap to be slidably received therethrough.

3. The bushing in combination with the abrasive flap wheel of claim 1, wherein said bushing includes an annular inner surface extending from said collar towards said laterally extending lip of said disk member and which configured for disposal adjacent an outer surface of said end cap.

4. The bushing in combination with the abrasive flap wheel of claim 3, wherein said annular inner surface includes am inwardly disposed portion which is recessed from not in contact with said outer surface said end of such that an outer portion of said annular inner surface generally serves as a contacting surface portion with said outer sure of the end cap.

5. The bushing in combination with the abrasive flap wheel of claim 1, why said bushing includes at least one bore which extend inwardly from a outer surface of said disk member.

6. The bushing in combination with the abrasive flap wheel of claim 5, wherein said bushing includes a plurality of bores which are radially equidistantly spaced from one another.

7. An improvement for a high torque abrasive wheel, wherein the abrasive wheel includes an abrasive flap wheel having an annular array of abrasive leaves, said leaves having bases which are interconnected by an adhesive and have two notches in their opposite side edges adjacent an end thereof each leaf such that said notches form concentric to circular depressions on opposite sides of said array, a pair of circular end caps mounted on opposite sides of said annular array of abrasive leaves wherein each end cap has a central open surface, an outer rim portion and an arcuate lip inwardly extending therefrom which engages said circular depressions formed by said noshes thereby mechanically gripping ends of the abrasive leaves wherein said improvement includes a bushing having a first rigid disk member having an outer diameter formed with an laterally extending lip which is configured to at least partially seat within a concave portion of said arcuate lip and engage and retain one of said end caps adjacent said rim portion thereof, and a central hub having a central open surface which cooperatively aligns with said central open surface of; said one end cap to receive a drive shaft therethrough a second rigid disk member having an outer diameter formed with an laterally extending lip which is configured to at least partially seat within a concave portion of said arcuate lip and engage and retain another of said end caps adjacent said rim portion thereof, and a central hub having a central open surface which cooperatively aligns with said central open surface of said another end cap to receive a drive shaft therethrough.

8. The improvement for a high torque abrasive wheel of claim 7, wherein each of said central hubs of said disk members include an axially extending collar portion having an outer diameter slightly less than a diameter of the central open surface of said end caps to be slidably received therethrough.

9. The improvement for a high torque abrasive wheel of claim 7, wherein each of said disks members include an annular inner surface extending from said collar to said laterally extending lip of said disk member and which configured for disposal adjacent an outer surface of said end cap.

10. The improvement for a high torque abrasive wheel of claim 9, wherein each of said annular inner surfaces of said disk members include a inwardly disposed portion which is recessed such that an outer portion of said annular inner surface generally serves as a contacting sac portion with said the outer surface of said end caps.

11. The improvement for a high torque abrasive wheel of claim 7, wherein each of said disk members include at least one bore which extend inwardly from an outer surface of each said disk member.

12. The improvement for a high torque abrasive wheel of claim 11, wherein each of said disk member include a plurality of bores which are radially equidistantly spaced from one another.

* * * * *